United States Patent [19]

Jochum

[11] Patent Number: 4,534,500

[45] Date of Patent: Aug. 13, 1985

[54] SETTING DEVICE WITH A DRIVING PISTON PROPELLED BY HIGH PRESSURE GASES

[75] Inventor: Peter Jochum, Meiningen, Austria

[73] Assignee: Hilti Aktiengesellschaft, Schaan, Liechtenstein

[21] Appl. No.: 449,821

[22] Filed: Dec. 14, 1982

[30] Foreign Application Priority Data

Dec. 28, 1981 [DE] Fed. Rep. of Germany ..... 3151658

[51] Int. Cl.[3] ..... B27F 7/17

[52] U.S. Cl. ..... 227/7; 227/8; 227/156; 227/2; 173/13

[58] Field of Search ..... 227/8, 9, 10, 2, 5, 227/6, 7; 173/13, 14, 15, 16, 17, 116

[56] References Cited

U.S. PATENT DOCUMENTS 3,504,840 4/1970 Wandel et al. .
3,796,270 3/1974 Lange ..... 227/8 X
4,091,981 5/1978 Moriguchi et al. ..... 227/8
4,227,637 10/1980 Haytayan ..... 227/8
4,351,464 9/1982 Fehrs et al. ..... 227/8 X
4,403,722 9/1983 Nikolich ..... 227/8 X

*Primary Examiner*—E. R. Kazenske
*Assistant Examiner*—William Fridie, Jr.
*Attorney, Agent, or Firm*—Toren, McGeady, Stanger, Goldberg & Kiel

[57] ABSTRACT

A setting device uses a driving piston for propelling fastening members into a receiving material. High pressure gases within an expansion chamber propel the driving piston through a working cylinder against a fastening element. A vent valve connects the expansion chamber with the atmosphere exterior of the setting device and, normally, the valve is maintained in the open position. A control member, located in part on the outside of the setting device, moves the vent valve into the closed position when a fastening member is to be driven.

6 Claims, 1 Drawing Figure

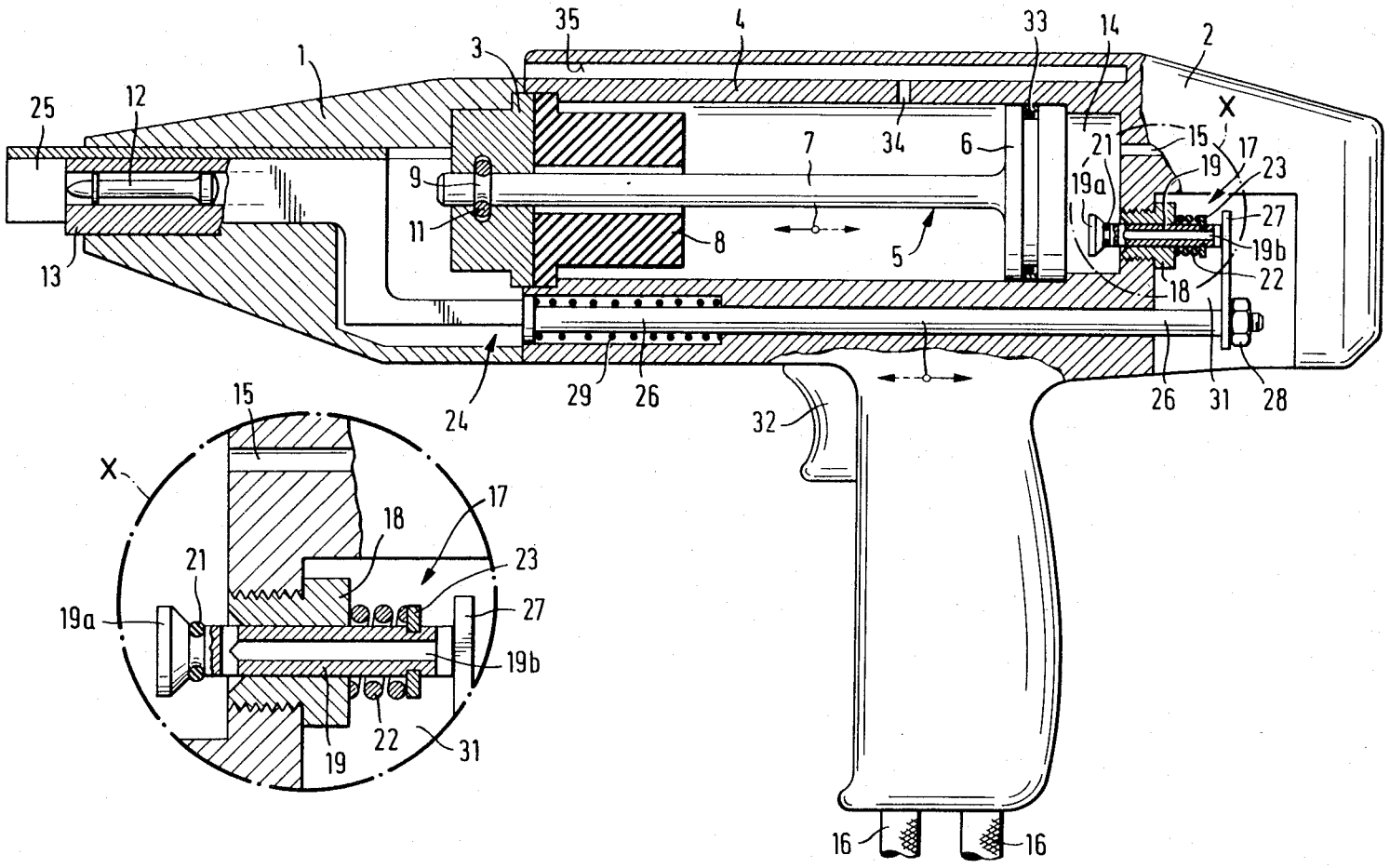
1
2
3
4
5
6
7
8
9
11
12
13
14
15
16
17
18
19
19a
19b
21
22
23
24
25
26
27
28
29
31
32
33
34
35
X

SETTING DEVICE WITH A DRIVING PISTON PROPELLED BY HIGH PRESSURE GASES

SUMMARY OF THE INVENTION

The present invention is directed to a setting device using a driving piston for propelling fastening members into a receiving material. The driving piston is displaced through a working chamber by high pressure gases. The gases are introduced to an expansion chamber in communication with the working cylinder and a vent valve in the open position connects the expansion chamber with the atmosphere exterior of the setting device.

Setting devices of this general type are used to drive nails and similar fastening members into receiving materials. A driving piston is supported in the device and undergoes a high speed stroke developed by high pressure gases acting against the piston for driving the nail into the receiving material.

The high pressure gases which propel the driving piston may be compressed air or the combustion gases of a powder or gaseous propellent charge. The compressed air or the combustion gas is directed into an expansion chamber where its pressure is increased so that it can act on the driving piston.

To effect the return of the driving piston into its rear starting position, after a fastening member setting cycle has been completed, the expansion chamber is connected with the atmosphere by a vent valve as the piston is returned.

At the commencement of a working cycle, the vent valve is closed due to a coupling action. To prevent an accidental initiation of the working cycle, for instance, when the device is not placed against the receiving material, pressure acting safety mechanisms are known which prevent the commencement of a working stroke. These known devices are complicated in construction and tend to fail due to contamination.

Therefore, the primary object of the present invention is to provide a setting device of the type described above with a simple control for the vent valve which increases the operational safety of the setting device.

In accordance with the present invention, the vent valve is operated by a control member which can be activated from the outside of the setting device.

A control member activated on the outside of the setting device assures that the setting procedure can be intiated, first, when the control member is displaced and subsequently, by the intentional action of the operator, when the release device is actuated. For instance, when the control member is operated it can be displaced, against a spring tension acting in the driving direction, toward the handle of the device so that the control member is displaced only after the setting device is pressed against the receiving material with a force sufficient to overcome the spring tension holding the control member in position outwardly from the setting device. Initially, the vent valve is held in the open position before the control member is displaced so that the expansion chamber is connected to the atmosphere exterior of the device and the displacement of the control member against the tension force closes the vent valve so that the expansion chamber is sealed off from the atmosphere.

In setting devices operated by combustion gases, such an operation sequence assures that the setting process can be initiated when ignitible gases are introduced into the expansion chamber and the vent valve is in the closed position due to the displacement of the control member. If the vent valve is not in the closed position, then the gases introduced into the expansion chamber flow through the open vent valve to the atmosphere. Any subsequent ignition of the gases within the expansion chamber does not lead to a pressure increase sufficient to carry out the fastening member propulsion procedure.

Preferably, the control member includes a sensing element which projects outwardly from the opening or muzzle of the setting device from which the fastening member is propelled. Advantageously, the sensing element is supported in the device so that it is slidable parallel to the driving axis and projects in the driving direction from the opening of the setting device when it is in the inactive position. With such an arrangement, the sensing element can be activated when the setting device is pressed against the receiving material into which the fastening member is to be driven. The sensing element may be a rod-like member with a crossarm at its rear end for moving the vent valve stem into the closed position.

Another feature of the invention is the provision of a force accumulator associated with the vent valve for moving the valve into the closed position. Advantageously, the force accumulator is a tension spring acting on the valve stem to bring its closing cone into a sealed position. Such an arrangement is distinguished by its simplicity and reliability of operation.

Another feature of the invention involves the use of a spring acting against the force accumulator of the vent valve for maintaining the sensing element in the inactive position so that the force exerted by the spring is greater than that of the force accumulator. As a result, the spring acting on the sensing element holds the vent valve in the open position when the sensing element and the setting device are in the inactive position. Only manual activation of the control member by the operator applying a force against the spring tension acting on the sensing element makes it possible to close the vent valve which closing action is assured by the force accumulator of the vent valve.

BRIEF DESCRIPTION OF THE DRAWING

In the drawing a setting device is shown, partly in section, illustrating a preferred embodiment of the present invention with the setting device held in the inactive or inoperative position and with an encircled detail X showing a portion of the setting device on a larger scale.

DETAILED DESCRIPTION OF THE INVENTION

As seen in the drawing, the setting device is made up of a front casing portion 1 and a rear casing portion 2. The front casing portion 1 forms an opening from which a fastening member 12, such as a nail, can be driven into a receiving material, not shown. The two casing portions 1, 2 are connected, in axial alignment, by a centering disk 3.

Rear casing portion 2 forms a working cylinder 4 through which a driving piston 5 is slidably displaceable. Driving piston 5 is made up of a head 6 located at its rear end and guided within the working cylinder and an axially elongated shank or shaft 7 extending forwardly from the front side of the head toward the opening from the setting device. As shown in the drawing, with the driving piston in the inactive position, the forward end of the shaft 7 extends into a bore passing axially through the centering disk 3. In addition, the shaft 7 extends through an elastic material buffer 8 located immediately behind the centering device with the buffer supported on the disk. In other words, the forward end of the shaft 7 within the working cylinder 4 passes through the buffer 8 and then into the disk 3. Adjacent its forward end, shaft 7 has a circular groove 9 into which a radially yieldable retaining ring 11 fits when the setting device is in the inactive position ready to drive a fastening member. A guide tube or barrel 13 is supported within the front casing portion 1 in axial alignment with the openings through the buffer 8 and the disk 3. The front end, the left end as viewed in the drawing, of the barrel 13 forms the opening of the setting device. The nail 12 is inserted into the forward end of the barrel in alignment with the shaft 7 of the driving piston 5 so that the piston propels the fastening member 12 out of the opening at the front end of the barrel 13 and into a receiving material, not shown.

At the rear or head end of the driving piston 5, as shown in the drawing, the rear casing portion 2 forms an expansion chamber 14 in communication with the rear end of the working cylinder 4 in which the driving piston is located. As can be seen in the drawing the rear end of the working cylinder 4 has a slightly larger diameter than that of the expansion chamber 14 forming a stop or shoulder limiting the rearward displacement of the driving piston 5. An inlet duct 15 is located in the rear casing portion and opens into the expansion chamber 14 for admitting combustible gases into the chamber. A control circuit including a check valve which is not an essential part of the invention and, therefore, is not shown in the drawing, serves to supply the gases to the expansion chamber. The gases are supplied from an external source, via lines 16 which extend through the handle, into the setting device.

A vent valve 17 opens into the expansion chamber 14. As can be seen more clearly in the encircled detail X, vent valve 17 includes a bushing 18 threaded into the part of the rear casing portion 2 defining the rear wall of the expansion chamber 14. A tubular valve stem 19 extends through the bushing 18 and it has an enlarged partly frusto-conically shaped sealing head 19*a* at its front end with a sealing ring 21 encircling the stem 19 at the smaller diameter end of the frusto-conical portion of the head. Extending from the rearward end of the bushing 18 is a force accumulator 22 in the form of a compression spring, encircling the valve stem 19 and bearing at its rearward end against a supporting disk 23 secured on the valve stem.

In the inactive or inoperative position of the setting device, as shown in the drawing, the vent valve 17 is held in the open position by a control member or sensing element 24. Sensing element 24 includes a probing member 25 displaceable in the axial direction of the setting device and, as can be seen in the drawing, in the inactive position of the device, the probing member projects axially forwardly from the opening in the guide tube or barrel 13 from which the fastening elements are driven. In other words, the forward end of the probing member 25 is spaced axially forwardly of the forward end of the barrel 13 in the inactive position of the setting device. The probing member 25 extends into the front casing portion 1 and has an offset portion at its rearward end in engagement with an axially extending thrust rod 26 which extends through the lower portion of the rear casing portion forming the working cylinder 4. The rearward end of thrust rod 26 is located rearwardly of the expansion chamber 14 and it has a crossarm 27 extending transversely of the axial direction of the setting device which extends from the thrust rod into contact with the rear end of the valve stem 19. The crossarm 27 is fixed to the rear end of the thrust rod by a nut 28. Within the forward end of the rear casing portion 2, a spring 29 biases the thrust rod 26 and the probing member 25 into the illustrated inactive or inoperative position. Since the force of the spring 29 is greater than that of the force accumulator 22 the valve stem 19 is held in the open or venting position. In this open position, any gases which flow through the inlet duct 15 into the expansion chamber 14 pass, in turn, through the bore 19*b* within the valve stem and into an open space 31 in the rear casing portion 2 which is open to the atmosphere. Accordingly, in the position shown in the drawing, any gases introduced into the expansion chamber 14 flow through the vent valve 17 to the space 31 open to the ambient atmosphere exterior of the setting device.

To drive a fastening member from the setting device into the receiving material, the opening from the device must be pressed against the receiving material. When the opening from the setting device is pressed against the receiving material, the probing member 25 and the thrust rod 26 move in the direction opposite the firing or driving direction against the biasing action of the spring 29. The rearward movement of the thrust rod 26 displaces the crossarm 27 from the rear end of the valve stem 19 and the valve stem is displaced rearwardly into its closed position by its force accumulator 22. When the valve stem is moved rearwardly through the bushing 18 its sealing ring 21 moves into contact with the front end of the bore through the bushing 18 and the frusto-conical portion of the sealing head 19*a* bears against the corresponding frusto-conical countersunk portion of the bore within the bushing 18. This tight fit is increased by the high pressure gases and the sealing ring 21 is protected. By pressing a trigger 32 located in the handle of the setting device, the expansion chamber 14 is filled with gases flowing through the control circuit and the inlet duct 15. Since the vent valve is in the closed position, the gases entering through the duct 15 are held in the expansion chamber 14. Further, the driving piston head 6 is provided with an annular seal 33 in engagement with the inside surface of the working cylinder 4 preventing any outflow of the gases. Retaining ring 11 engaged in the annular groove 9 holds the driving piston 5 against movement in the driving direction due to the pressure of the gases introduced into the expansion chamber.

In the next step in the fastening member setting cycle procedure, the actuation of the trigger 32 ignites the gases in the expansion chamber, an ignition device effects the combustion of the gases and an ignition plug can be used as such a device which is known per se and is not illustrated for reason of simplification. The high pressure gases resulting from the ignition of the gases in the expansion chamber 14 propels the driving piston 5 toward the front casing portion 1 of the setting device with the shaft 7 of the driving piston 5 moving into contact with the fastening element 13 for driving it out of the barrel and into the receiving material. Initially, the high pressure gases overcome the locking engagement of the shaft 7 within the centering disk 3 by the action of the ring 11 within the groove 9. After reaching its maximum speed, the head 6 of the driving piston 5 moves forwardly beyond an exhaust opening 34 in the working cylinder 4 and the exhaust opening communicates with a gap 35 in the rear casing portion 2 which is open to the atmosphere.

Having propelled the driving piston forwardly through the working cylinder 4, the ignited high pressure gases can escape to the atmosphere through the exhaust opening 34 and the gap 35.

After the completion of the fastening element setting procedure, the setting device is lifted off the receiving material and the sensing element 24 and the vent valve 17 automatically return to the initial inactive position, shown in the drawing, due to the biasing action of the spring 29. The driving piston 5 is then returned into the position shown in the drawing ready to commence another fastening element setting procedure, with the return of the driving piston being effected by means of ram, not shown.

If the trigger 32 in the setting device is actuated when the device is not pressed against the receiving material or the sensing element is not displaced rearwardly, the driving piston cannot be propelled forwardly, because any gases introduced into the expansion chamber 14 will flow to the atmosphere through the open vent valve 17 and any subsequent ignition of the gases will cause a practically pressureless combustion of the gas remaining in the expansion chamber 14.

While specific embodiments of the invention have been shown and described in detail to illustrate the application of the inventive principles, it will be understood that the invention may be embodied otherwise without departing from such principles.

I claim:

1. A setting device for inserting fastening members into a receiving material comprises wall means forming an axially extending working cylinder having a first end and a second end and with the axis thereof extending in the direction between the second end and the first end, a driving piston axially displaceably mounted within said working cylinder, said wall means forming an expansion chamber in communication with the second end of said working cylinder and arranged to receive a source of high pressure gases for displacing said driving piston axially through said working cylinder in the direction from the second end toward the first end thereof, and a vent valve opening directly into said expansion chamber and having a open position for connecting said expansion chamber to the atmosphere and a closed position preventing flow of the gases out of said expansion chamber, wherein the improvement comprises that said setting device has an inactive position where it is incapable of inserting fastening members and an active position for inserting fastening members, in the inactive and active position said expansion chamber forms a volume with said vent valve in the open position corresponding to the inactive position of said setting device connecting said expansion chamber to the atmosphere, operating means located at least in part axially outwardly from the first end of said working cylinder and accessible on the exterior of said setting device and being displaceable in the axial direction of said working chamber toward the second end thereof for placing said vent valve in the closed position whereby said setting device is in the active position, said wall means comprises a front casing portion forming an opening for driving fastening members from said setting device, and a rear casing portion including said working cylinder, said first end of said working cylinder disposed in communication with said front casing portion, and said operating means includes a sensing element located within said wall means and extending outwardly from the opening from said setting device in the direction forming an extension of the axis of said working cylinder, a force accumulator is incorporated in said vent valve for biasing said vent valve into the closed position, a spring mounted in said wall means in operative engagement with said sensing element for biasing said sensing element in the direction outwardly from the opening from said setting device, and said sensing element being in contacting engagement with said vent valve for maintaining said vent valve in the open position with said spring overriding the biasing action of said force accumulator when said setting device is in the inactive position.

2. A setting device, as set forth in claim 1, wherein said first casing portion includes a barrel arranged to receive a fastening member, said barrel disposed in axial alignment with said driving piston, said driving piston including an axially extending shaft portion axially displaceable from said working cylinder into said barrel for driving said fastening member into the receiving material, and means connecting said front and rear casing portions together.

3. A setting device, as set forth in claim 2, wherein said means connecting said front and rear casing portions together includes a radially yieldable retaining ring, said shaft of said driving piston having an annular groove adjacent the front end thereof so that said retaining ring engages within said annular groove and secures said driving piston in the inactive position.

4. A setting device, as set forth in claim 2, wherein said sensing element comprises a member slidably displaceably mounted in said front and rear casing portions, the rearward end of said sensing element having a crossarm extending transversely of the axial direction of said driving piston and engageable with said vent valve for biasing said vent valve into the open position.

5. A setting device, as set forth in claim 4, wherein said vent valve comprises a bushing threadedly engageable within said rear casing portion and opening to said expansion chamber, a valve stem slidably displaceable within said bushing with one end of said valve stem extending into said expansion chamber and the other end of said valve stem located rearwardly of said bushing, said second casing portion forming an open space therein open to the atmosphere, and the rear end of said valve stem located within said open space, said valve stem being tubular and forming a passageway communicating between said expansion chamber and the open space within said rear casing portion when said vent valve is displaced by said sensing element.

6. A setting device, as set forth in claim 5, wherein said end of said valve stem located within said expansion chamber is arranged to form a seal with said bushing when said force accumulator displaces said vent valve into the closed position.

* * * * *